US010406521B2

(12) United States Patent
Lal et al.

(10) Patent No.: US 10,406,521 B2
(45) Date of Patent: Sep. 10, 2019

(54) MICRO-DROPLET ARRAY FOR MULTIPLE SCREENING OF A SAMPLE

(71) Applicant: SHILPS SCIENCES PRIVATE LIMITED, Bangalore (IN)

(72) Inventors: Ashwin Lal, Byramji Town Nagpur (IN); Ankit Shantilal Purohit, Bhavnagar (IN); Madhavi Phani Singaraju, Kakinada (IN)

(73) Assignee: SHILPS SCIENCES PRIVATE LIMITED, Bangalore (IN)

( * ) Notice: Subject to any disclaimer, the term of this patent is extended or adjusted under 35 U.S.C. 154(b) by 0 days.

(21) Appl. No.: 15/119,133

(22) PCT Filed: Feb. 20, 2015

(86) PCT No.: PCT/IN2015/000098
§ 371 (c)(1),
(2) Date: Aug. 16, 2016

(87) PCT Pub. No.: WO2015/125158
PCT Pub. Date: Aug. 27, 2015

(65) Prior Publication Data

US 2017/0007997 A1 Jan. 12, 2017

(30) Foreign Application Priority Data

Feb. 21, 2014 (IN) ..... 882/CHE/2014

(51) Int. Cl.
*B01L 3/00* (2006.01)

(52) U.S. Cl.
CPC . *B01L 3/502784* (2013.01); *B01L 2200/0652* (2013.01); *B01L 2300/0645* (2013.01);
(Continued)

(58) Field of Classification Search
CPC ..... B01L 2300/0819; B01L 2300/0829; B01L 2300/0832; B01L 2300/0861; B01L 2300/0864; B01L 2300/0867; B01L 2300/087; B01L 2300/0887; B01L 3/502753; B01L 3/5027; B01L 3/502707; B01L 3/502761; B01L 3/502792
See application file for complete search history.

(56) References Cited

U.S. PATENT DOCUMENTS 6,284,113 B1 9/2001 Bjornson et al.
6,613,284 B2 * 9/2003 Cleveland ..... B01J 19/0046 101/37

(Continued)

OTHER PUBLICATIONS

Dino Di Carlo and Luke P. Lee "Cell Analysis for Quantitative Biology" Analytical Chemistry , Dec. 1, 2006, University of California Berkely.

(Continued)

*Primary Examiner* — Brian R Gordon
(74) *Attorney, Agent, or Firm* — Mark M. Friedman

(57) ABSTRACT

The invention provides a micro-droplet array formation apparatus. The apparatus includes a first plate configured for delivering and/or extracting fluids, a second plate aligned to the first plate and configured for preparing the fluid and a third plate removably aligned to the second plate and is configured for forming a micro-droplet array of the prepared fluid.

6 Claims, 12 Drawing Sheets

(52) U.S. Cl.
CPC ..... *B01L 2300/0816* (2013.01); *B01L 2300/0864* (2013.01); *B01L 2300/0867* (2013.01); *B01L 2300/0883* (2013.01); *B01L 2300/0887* (2013.01)

(56) References Cited

U.S. PATENT DOCUMENTS

| | | | | |
|---|---|---|---|---|
| 6,623,613 | B1 * | 9/2003 | Mathies | B01L 3/5025 204/450 |
| 6,773,566 | B2 | 8/2004 | Shenderov | |
| 7,998,437 | B2 * | 8/2011 | Berndt | B01L 3/502715 422/503 |
| 8,584,703 | B2 | 11/2013 | Kobrin et al. | |
| 2005/0026134 | A1 | 2/2005 | Miller et al. | |
| 2006/0019333 | A1 * | 1/2006 | Rodgers | B01D 61/002 435/41 |
| 2006/0233670 | A1 * | 10/2006 | Lehto | B01L 3/0293 422/400 |
| 2007/0003448 | A1 * | 1/2007 | Kanigan | B01L 3/0244 422/400 |
| 2007/0166199 | A1 * | 7/2007 | Zhou | B01L 3/5025 422/400 |
| 2011/0166027 | A1 | 7/2011 | Weiner | |
| 2012/0128549 | A1 * | 5/2012 | Zhou | B01L 3/5025 422/504 |
| 2012/0196288 | A1 * | 8/2012 | Beer | B01L 3/502761 435/6.12 |
| 2013/0118901 | A1 | 5/2013 | Pollack et al. | |
| 2013/0130232 | A1 * | 5/2013 | Weibel | G01N 33/54386 435/5 |
| 2014/0010733 | A1 | 1/2014 | Ye et al. | |
| 2014/0174926 | A1 | 6/2014 | Bort et al. | |
| 2014/0179021 | A1 * | 6/2014 | Parkinson | B01D 11/0496 436/177 |
| 2015/0132742 | A1 * | 5/2015 | Thuo | B01L 3/502707 435/5 |
| 2016/0116393 | A1 * | 4/2016 | Cho | G01N 15/1056 422/502 |
| 2016/0184789 | A1 * | 6/2016 | Takagi | B01J 19/0093 422/502 |

OTHER PUBLICATIONS

Christopher E. Sims and Nancy L. Allbritton "Analysis of Singel Mammalian Cells On-Chip" Lab Chip, 2007, 423-440. DOI 10.1039/661525j.

Joel Voldman "Electrical Forces for Microscale Cell Manipulation", Mar. 29, 2006. DOI 10.1146/annurev.bioeng.8.061505.095739. The Annual Review of Biomedical Engineering.

Diane Longo and Jeff Hasly "Dynamics of Single-Cell Gene Expression" Modeular Systems Biology. May 5, 2006, Article 64, DOI 10.1038/msb4100110.

Helen Andersson Svahn and Albert Van Den Berg "Single Cells or Large Populations?" Lap Chip, 2007, 544-546. DOI 10.1039/b704632b.

* cited by examiner

MICRO-DROPLET ARRAY FOR MULTIPLE SCREENING OF A SAMPLE

FIELD OF INVENTION

The invention generally relates to the field of microfluidics and particularly to devices and methods for obtaining a micro-droplet array for multiple screening of a sample.

BACKGROUND

There have been various studies to determine the response of a group of cells to a given stimuli. The premise to this multi-cell study has been that the response of a cell is the average response of all cells present in the sample cells. The averaging of the response is driven by the notion that cells of same type are homogeneous. However, there have been various reviews of scientific literature on single cell analysis performed by various groups. Some prominent reviews include but are not limited to Andersson Svahn, 2007; Di Carlo and Lee, 2006; Longo and Hasty, 2006; Sims and Allbritton, 2007 and Voldman, 2006 which have been incorporated herein by reference. One significant finding common to the aforementioned reviews is the presence of heterogeneity even amongst cells of same cell type. Hence, it is important to isolate cells individually and then study the response of the isolated cell with respect to a stimulus. There are methods available in the prior art that utilize techniques which include but are not limited to flow cytometry, fluorescence microscopy, magnetic activated cell sorting, charge flow separation and microfluidics to analyse cells. One significant disadvantage of the methods is the lack of specificity in depleting a particular type of cell from a mixture. However, there are methods known to exist that enable isolation of single cells. The isolation of cells of a particular type from a mixture is essential for detection of rare cells. Examples of rare cells include but are not limited to Circulating Tumour cells (CTC), Cancer Stem Cells (CSCs), Circulating Endothelial cells (CECs), Circulating Endothelial Progenitors (CEPs) and prenatal foetal cells. Another application of isolation of cells is to detect the most efficient cells for production of antibodies. Another application of isolation of cells is to monitor or characterize cell behaviour for immuno therapies or stem cell therapies. Another application of isolation of cells is to do single cell genomics. Further the isolated cell should be accessibly stored for assays. There are methods available that utilize microfluidics to create a droplet array that is formed by coalescing an aqueous solution containing the cells with a predetermined assay reagent in presence of an immiscible liquid. There are also droplet arrays formed that are encapsulated in a gel for non invasive screening. A significant disadvantage of the aforementioned methods is that the array once formed cannot be used again for further screening.

BRIEF DESCRIPTION OF DRAWINGS

So that the manner in which the recited features of the invention can be understood in detail, some of the embodiments are illustrated in the appended drawings. It is to be noted, however, that the appended drawings illustrate only typical embodiments of this invention and are therefore not to be considered limiting of its scope, for the invention may admit to other equally effective embodiments.

SUMMARY OF THE INVENTION

Figure 1:
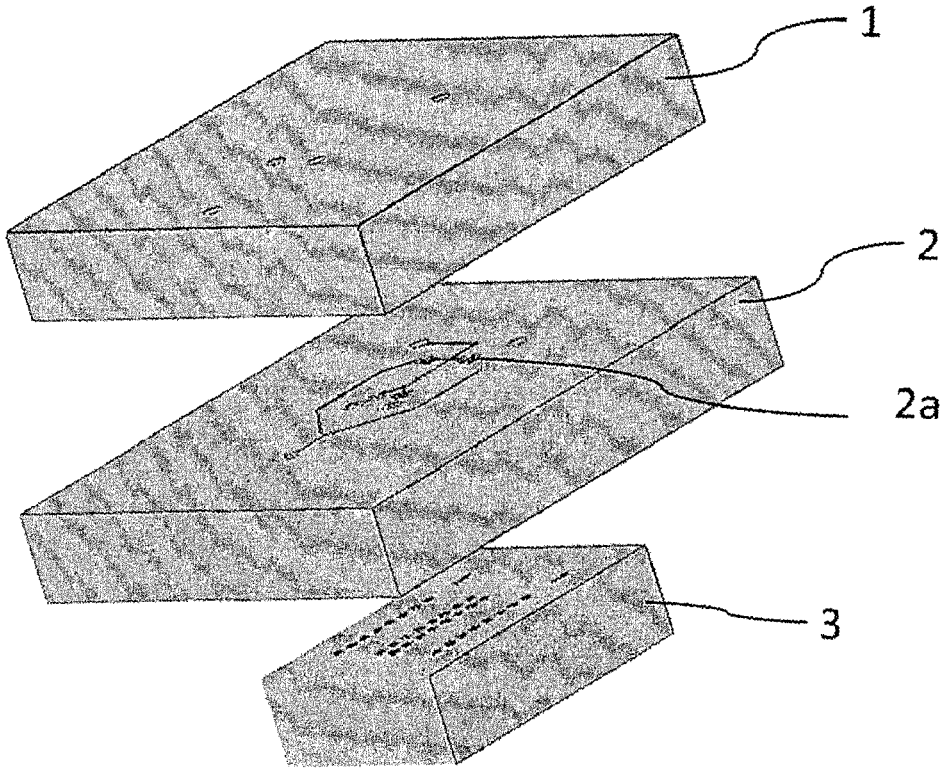
FIG. 1 shows an exploded view of the apparatus for formation of a micro-droplet array, according to an embodiment of the invention.

One aspect of the invention provides a micro-droplet array formation apparatus of a desired fluid. The apparatus includes a first plate configured for extracting and/or delivering a desired fluid, a second plate offset with the first plate configured for preparing the desired fluid and a third plate removably offset with the second plate configured for forming a micro-droplet array of the desired fluid.

Another aspect of the invention provides a micro-droplet array formation apparatus of a desired fluid. The apparatus includes a first plate having a top surface, a bottom surface and a second plate removably offset with the bottom surface of the first plate. The first plate is configured for preparing the fluid and the second plate is configured for formation of a micro-droplet array of the prepared fluid.

DETAILED DESCRIPTION OF THE INVENTION

Various embodiments of the invention provide a micro-droplet array formation apparatus of a desired fluid. The apparatus comprises of a first plate configured for delivering and/or extracting the desired fluid, a second plate offset with the first plate wherein the second plate is configured for preparing the desired fluid and a third plate removably offset with the second plate wherein the third plate is configured for forming a micro-droplet array of the desired fluid. The first plate is reversibly bonded with top surface of the second plate and covers up the microfluidic circuit present on top surface of the second plate. This helps to avoid leakage from the microfluidic circuit. The second plate has microfluidic circuits on both top and bottom surfaces, for performing encapsulation and sorting of droplets. A third plate with micro wells engraved on its top surface is in contact with the bottom surface of the second plate and there is presence of a thin film of oil between them so as to facilitate relative movement. The plates are made up of optically transparent material that includes but is not limited to glass, silicon, polymer (eg. PMMA, PDMS, polycarbonate), and similar materials used in micro fabrication. The microfluidic device is fabricated by the techniques including but not limited to lithography, micro milling, laser ablation, etching and precision machining.

In one embodiment of the invention, the apparatus is fabricated in PDMS by soft lithography. PDMS, being a hydrophobic material, is used for systems that use water in oil. For fabrication of the device, three master moulds are prepared. Two moulds for the second plate and one mould for the third plate. The master mould for PDMS fabrication is made in SU8 or silicon. For preparation of master mould, a silicon wafer is cleaned, spun coated with SU-8 photoresist, patterned and developed.

The pattern on the master mould is then directly transferred to the PDMS. For transferring, the PDMS mixture is poured over the mould placed in a petridish covered with an aluminium foil. This is then spin coated and cured or is directly cured in an oven or at room temperature. The PDMS is then peeled from the mould and is then cut in desired shape. The third plate is fabricated with this process. As the second plate has microfluidic circuit on both top and bottom surface of the plate, the structures are realized on two different moulds with PDMS and are then bonded together. By exposing PDMS to oxygen plasma, its surface becomes hydrophilic and more reactive. Both the PDMS pieces are exposed to the same oxygen plasma and immediately bonded.

The first plate is provided with at least two ports through which fluids are delivered or extracted. The delivery or extraction of the fluids is achieved through micro tubes from the micro channels present on the top surface of the second plate. A first fluid containing cells and a second fluid, both preferably being immiscible are introduced into the respective input ports of the first microfluidic circuit present on the top surface of the second plate. Both these fluids meet at a flow focusing junction where micro-droplets of first fluid in the second fluid are formed. The micro-droplets thus formed may or may not have samples present in them and hence they maybe then passed through a droplet sorter which sorts out the micro-droplets containing desired number of samples. The sorted micro-droplets are then passed to a port present on the second plate which then transports the micro-droplets to the second microfluidic circuit present on the bottom surface of the second plate. The third plate and the second plate are offset with respect to each other, allowing the desired fluid carrying the micro-droplets to flow in the microfluidic circuit formed by the bottom surface of the second plate and the top surface of third plate. Micro-droplets flowing past vacant wells present on the top surface of the third plate are trapped in the vacant wells, whereas if a well is already occupied, the micro-droplet simply flow through the micro channels and occupy the next vacant well. Once all the wells are occupied by the micro-droplets, the second plate and the third plate are moved relative to each other so as to disrupt the offset and hence the flow. The micro-droplets remain trapped in the wells. Finally, the third plate is displaced with respect to the second plate such that it is eventually not in contact with the second plate and is open. Various probing operations can then be performed on the micro-droplets containing the desired numbers of cells. The micro-droplet array formation apparatus explained herein above briefly shall be explained in detail through the drawings.

FIG. 1 shows an exploded view of the micro-droplet array formation apparatus, according to an embodiment of the invention. In one embodiment of the invention, the apparatus comprises of a first plate 1 configured for receiving and/or extracting desired fluids. A second plate 2 is positioned below the first plate 1. A first microfluidic circuit 2*a* is formed on the top surface of the second plate 2 and a second microfluidic circuit is formed on the bottom surface of the second plate 2 (not shown in figure). The first microfluidic circuit 2*a* is operatively connected to the second microfluidic circuit on the bottom surface of the second plate 2. A third plate 3 is configured to form an array and can be detachably positioned below the second plate 2. The offset of the second plate 2 with the first plate 1 is fixed reversibly by clamping the plates together or by thermal bonding.

Figure 2:
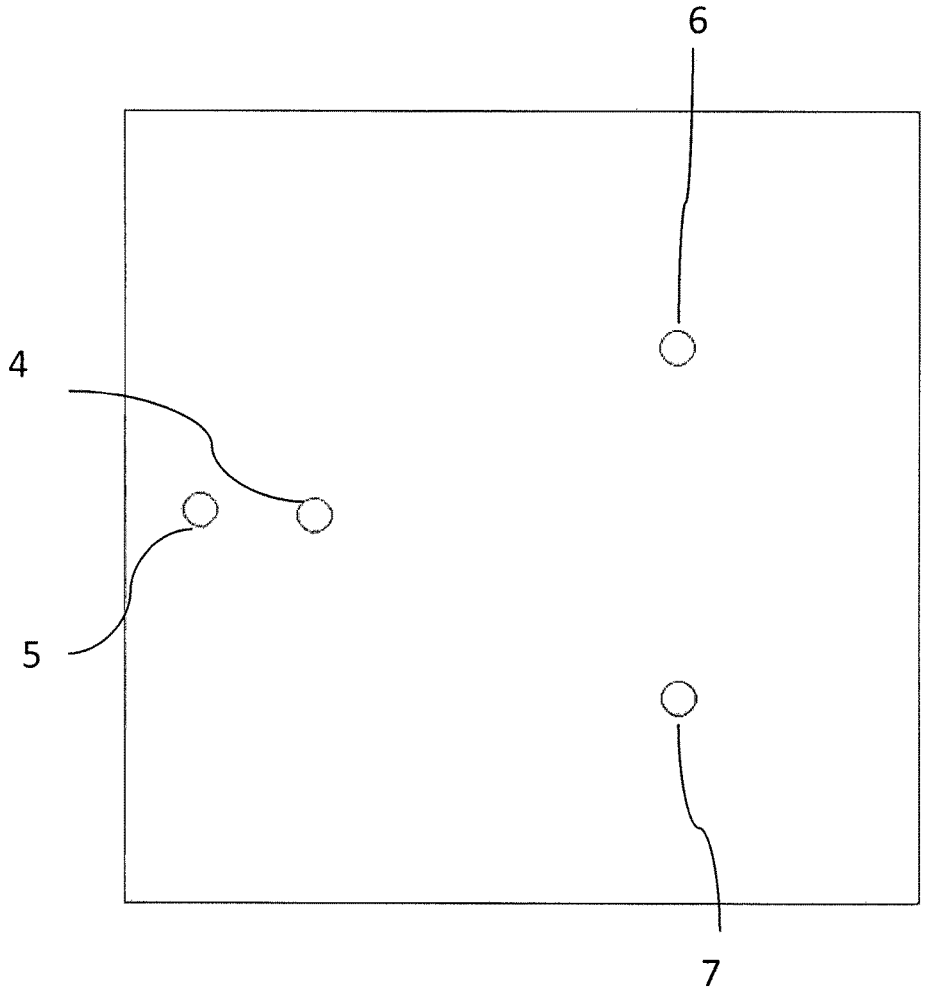
FIG. 2 shows a top view of the first plate of the apparatus, according to an embodiment of the invention.

FIG. 2 shows the top view of the first plate according to an embodiment of the invention. The first plate 1 is provided with at least two ports 4, 5 for delivering at least two distinct fluids into the microfluidic circuit 2*a* of the second plate 2. The first fluid is a sample fluid and the second fluid is an immiscible fluid. An outlet 6 is provided for extracting the unwanted micro-droplets from the microfluidic circuit after the sorting operation, whereas outlet 7 enables extraction of fluids from the apparatus at end of trapping operation. The fluids are delivered into the ports directly through delivery devices. The delivery devices include but are not limited to syringes, pipes, tubes and all such devices capable of delivering a fluid. Further, the flow of the fluids into the ports is regulated through pumps connected to the delivery devices.

Figure 3:
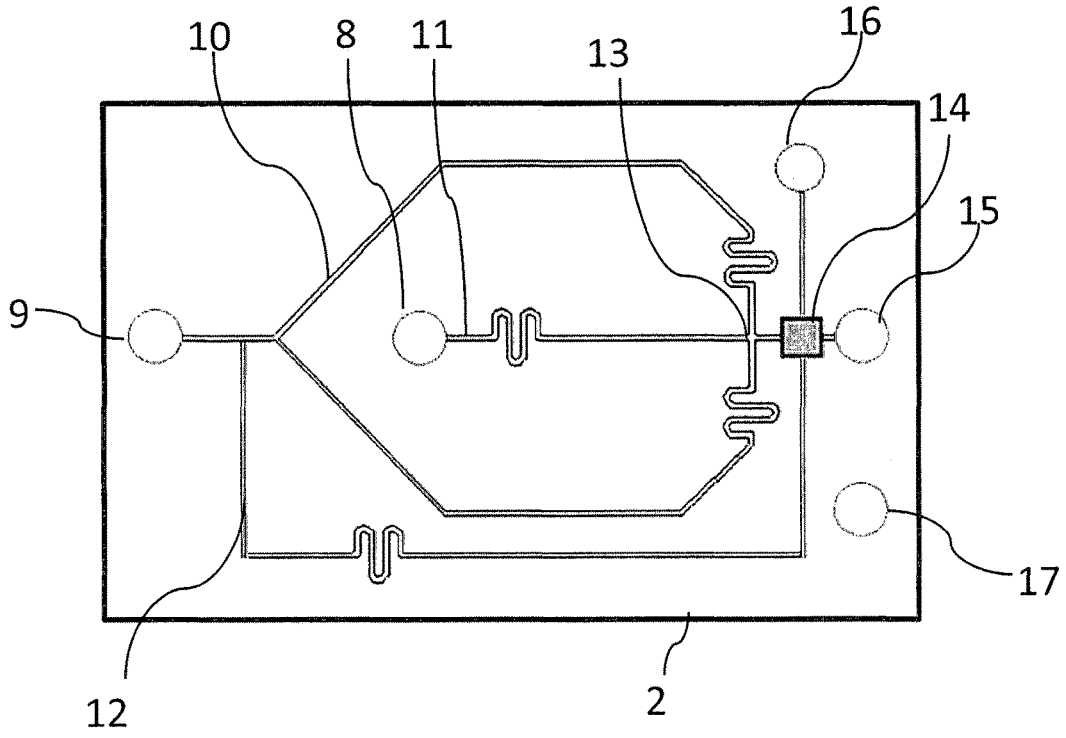
FIG. 3 shows a first microfluidic circuit formed on the top surface of the second plate, according to an embodiment of the invention.

FIG. 3 shows a first microfluidic circuit formed on the top surface of the second plate, according to an embodiment of the invention. The first microfluidic circuit 2*a* has input ports 8 and 9 for receiving fluids from ports 4 and 5 of the first plate 1(FIG. 2). The input ports 8 and 9 extend into microfluidic channels 10 and 11. The channels can be elongated, serpentine or combination of both. In one example of the invention, the input port 9 is configured to form two channels 10 and 12. The second fluid flowing in channel 12 is further used for preparation step for performing sorting operation at a droplet sorter 14. Alternatively, second fluid can be introduced into channel 12 of the droplet sorter 14 by means of an independent delivery device. The input port 8 is configured for delivering the sample fluid. The input port 9 is configured for delivering the immiscible fluid. The microfluidic channels 10 and 11 are configured to form a junction 13. The sample flowing in from the channel 10 coalesces with the immiscible fluid flowing from the channel 11 to form a micro-droplet proximal to the junction 13. The micro-droplets formed encapsulate the sample. There are also micro-droplets formed without any sample.

In one example of the invention a sample having at least one entity of interest is chosen. The entity selected is at least one from the group including but not limited to a normal single cell, a diseased single cell, and a macromolecule. Examples of single cell include but are not limited to single celled microorganisms, isolated single cells from tissues, red blood cells and white blood cells. Further, the macromolecule is at least one selected from the group including but not limited to a polypeptide, a polynucleotide, chemical compounds with molecular weight greater than $10^3$ kDa, enzymes and receptors. An immiscible liquid is also chosen. Example of immiscible liquid includes but is not limited to fluorinated oils, non-fluorinated oils, mineral oils, plant oils and comestible oils.

The fraction of micro-droplets carrying k cellular entities is given by $D_k=\lambda^k\exp(-\lambda)/k!$, where A is the average number of cellular entity per micro-droplet. The distribution indicates that micro-droplets without any cellular entity may form along with micro-droplets containing cellular entity.

To facilitate sorting of the micro-droplets containing cellular entity, a droplet sorter 14 is provided proximal to the junction 13. The droplet sorter 14 is configured to receive the micro-droplets. The channel 12 from the input port 9 is connected to the droplet sorter 14 to deliver the immiscible liquid at a direction perpendicular to the direction of flow of the micro-droplets into the droplet sorter 14. The micro-droplets containing the sample are then directed to a feeder port 15, subsequent to sorting. The feeder port 15 in-turn feeds into a micro-channel (not shown). The micro-droplets without the sample are retrieved through port 16. A receiver port 17 is provided for receiving the fluid from the micro-channel (not shown). The port 16 is accessible through the outlet 6 provided on the first plate 1 (FIG. 2).

Figure 4:
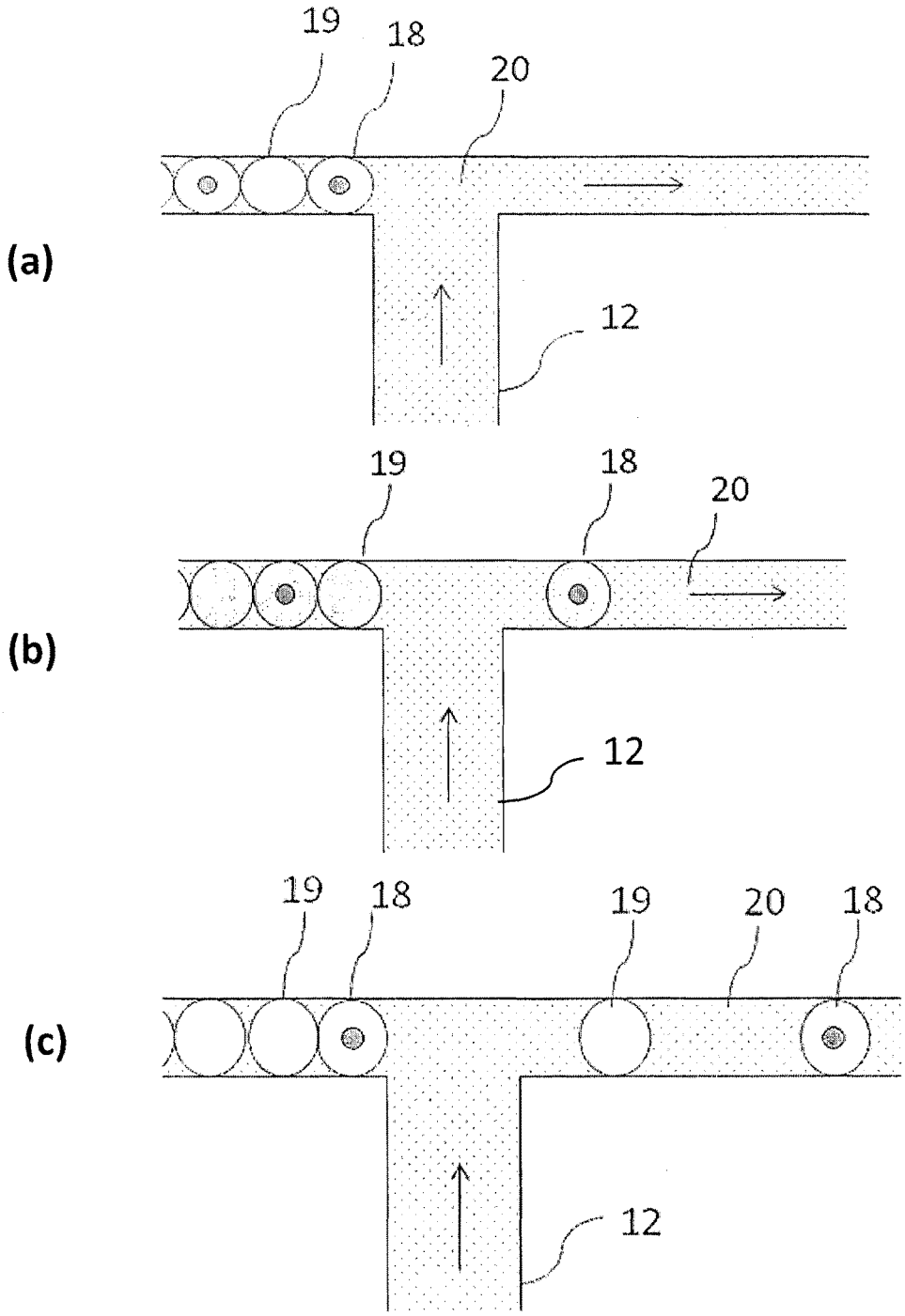
FIG. 4 shows the preparation step for the sorting, according to an embodiment of the invention.

FIG. 4 shows the preparation step for the sorting, according to an embodiment of the invention. The micro-droplets formed with the sample 18 and without the sample 19 are received upstream of the droplet sorter 14. The immiscible fluid flowing in from the channel 12 phases out the micro-droplets through creation of a spacer fluid 20. The phase separated micro-droplets are then fed into the sorter for sorting.

Figure 5:
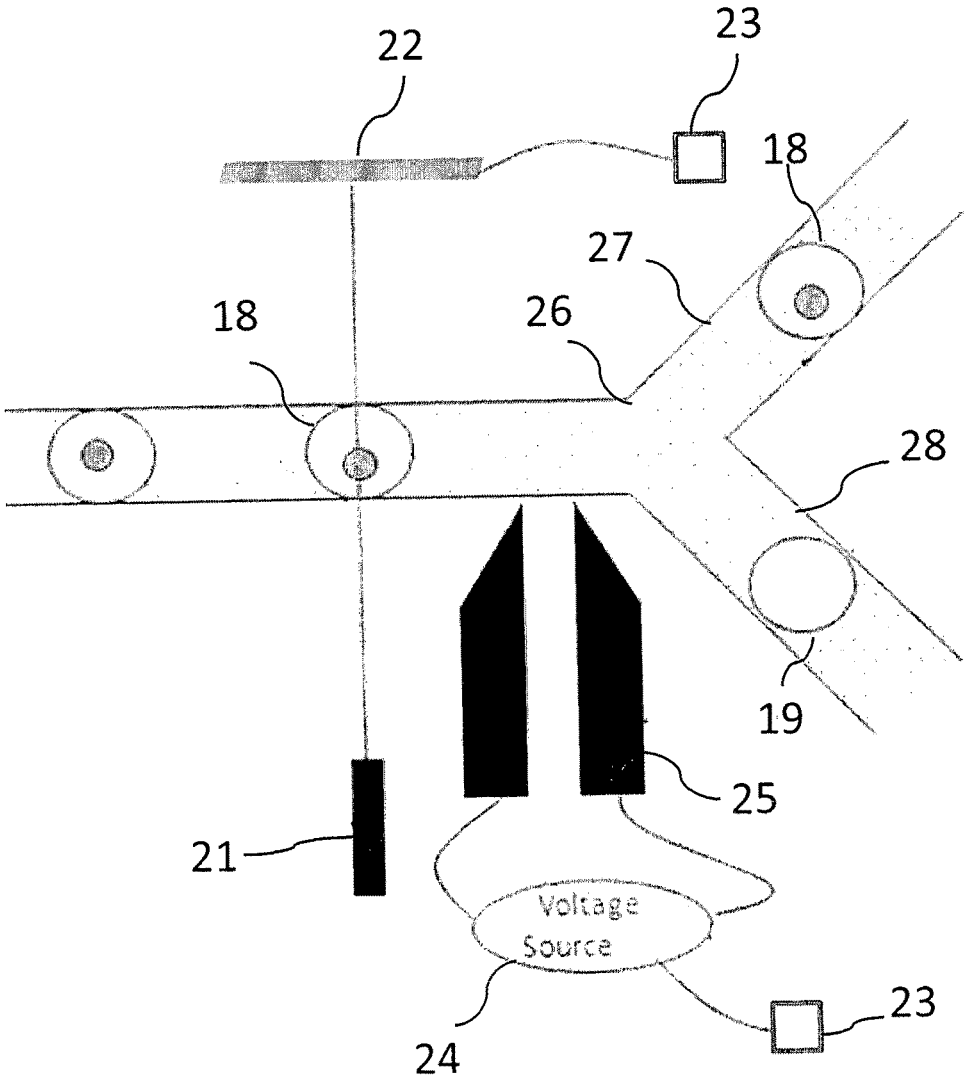
FIG. 5 shows the sorting of the micro-droplets, according to an embodiment of the invention.

FIG. 5 shows the sorting of the micro-droplets, according to an embodiment of the invention. The droplet sorter 14 provides for sorting of the micro-droplets on the basis of presence or absence of at least one cellular entity in the micro-droplet. The principle on which detection is based includes but is not limited to optical, electrical impedance, photo-imaging, magnetic and fluorescence. In one example of the invention the droplet sorter 14 sorts the micro-droplets based on optical measurement. A light either from a laser or light emitting diode 21 is directed at the microfluidic channel carrying the micro-droplets. The light after passing through the micro-droplet, for example a micro-droplet with the sample 18 falls on a detector 22, which in-turn is connected to a processor 23. The processor sends signal to a voltage source 24 which responds by either applying or not applying corresponding voltage to a pair of electrodes 25. The pair of electrodes 25 is positioned ahead of a junction 26 which separates the micro-droplet with the sample 18 from the micro-droplet without the sample 19. The junction 26 is configured to form channels 27 and 28 that feed into port 15 and port 16 respectively. When voltage is applied to the pair of electrodes 25, the micro-droplet containing cellular entities encounters a dielectrophoretic force corresponding to the voltage received by the electrodes. This dielectrophoretic force directs the micro-droplets with the sample 18 to the port 15 via channel 27. While the micro-droplets without the sample 19 do not experience any dielectrophoretic force and flows towards the output port 16 via channel 28 and subsequently out of the apparatus via the outlet 6 present on the first plate 1.

Figure 6:
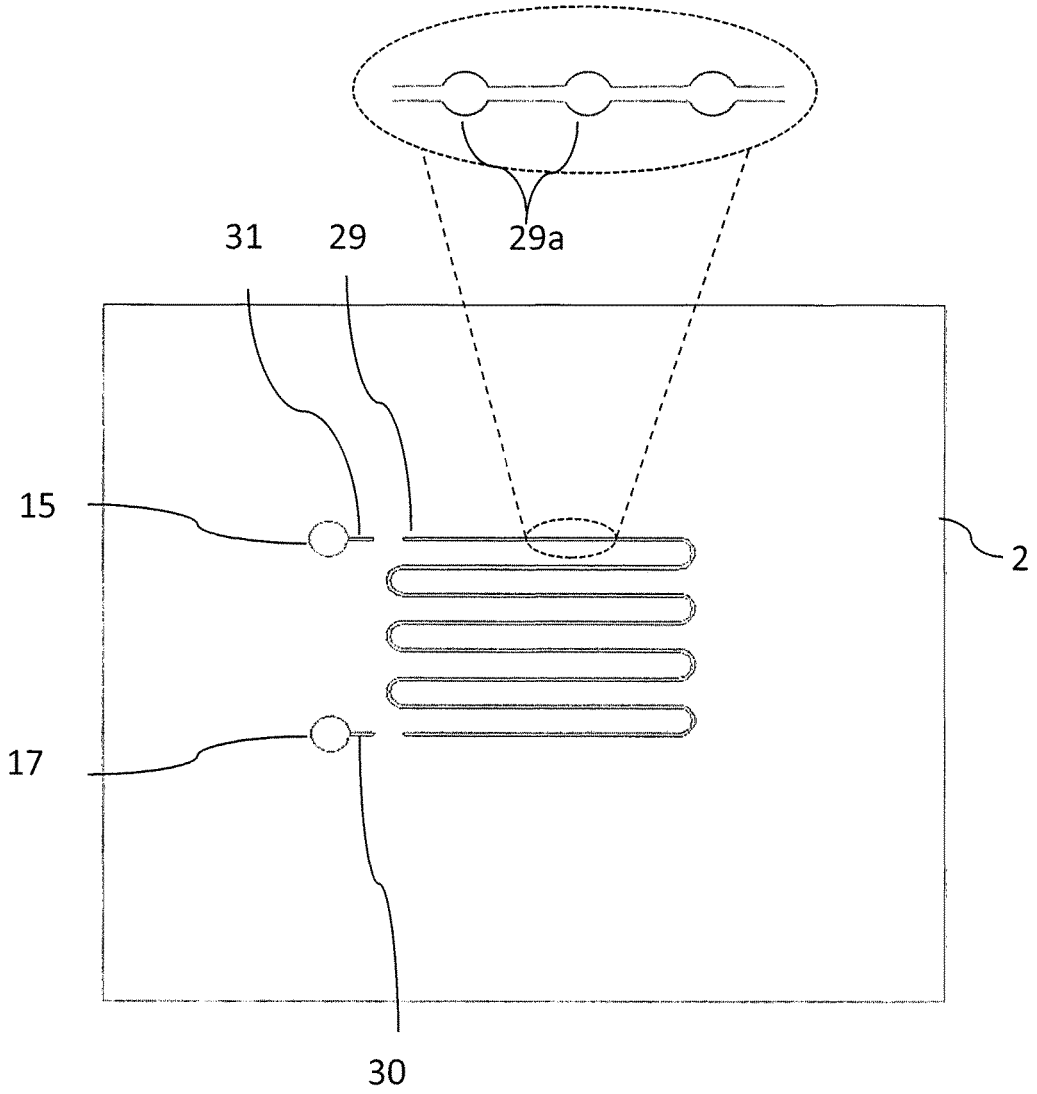
FIG. 6 shows a second microfluidic circuit on the bottom surface of the second plate, according to an embodiment of the invention.

FIG. 6 shows a second microfluidic circuit provided on bottom surface of the second plate according to an embodiment of the invention. The second microfluidic circuit includes a contiguous microchannel formed on the bottom surface of the second plate 2. The contiguous microchannel is formed with a microchannel 29, the feeder port 15 and the receiver port 17. The feeder port 15 and the receiver port 17 are extended into feeder channels 30 and 31 respectively. In one embodiment of the invention, the microchannel 29 is disjoint with the feeder channels 30 and 31, The microchannel 29 along with the feeder port 15 and receiver port 17 are configured to form a continuous channel upon contact with the third plate 3. In an alternate embodiment of the invention the microchannel 29 is in continuation with the feeder channels 30 and 31.

An arrangement for enabling trapping of single entities is provided on the microchannel 29. The microchannel 29 is provided with a plurality of circular slots 29*a* arranged in a two dimensional array. Each of the circular slots 29*a* is at a predetermined distance from the preceding one throughout the length of the microchannel 29. The distance between any two consecutive circular slots 29*a* is same as the distance between any two consecutive wells 32 in the third plate 3. The dimensions of the circular slots 29*a* are in correspondence with the dimensions of the wells 32. Presence of circular slots 29*a* on the microchannel 29 helps entrapping single entity in the wells 32.

Figure 7:
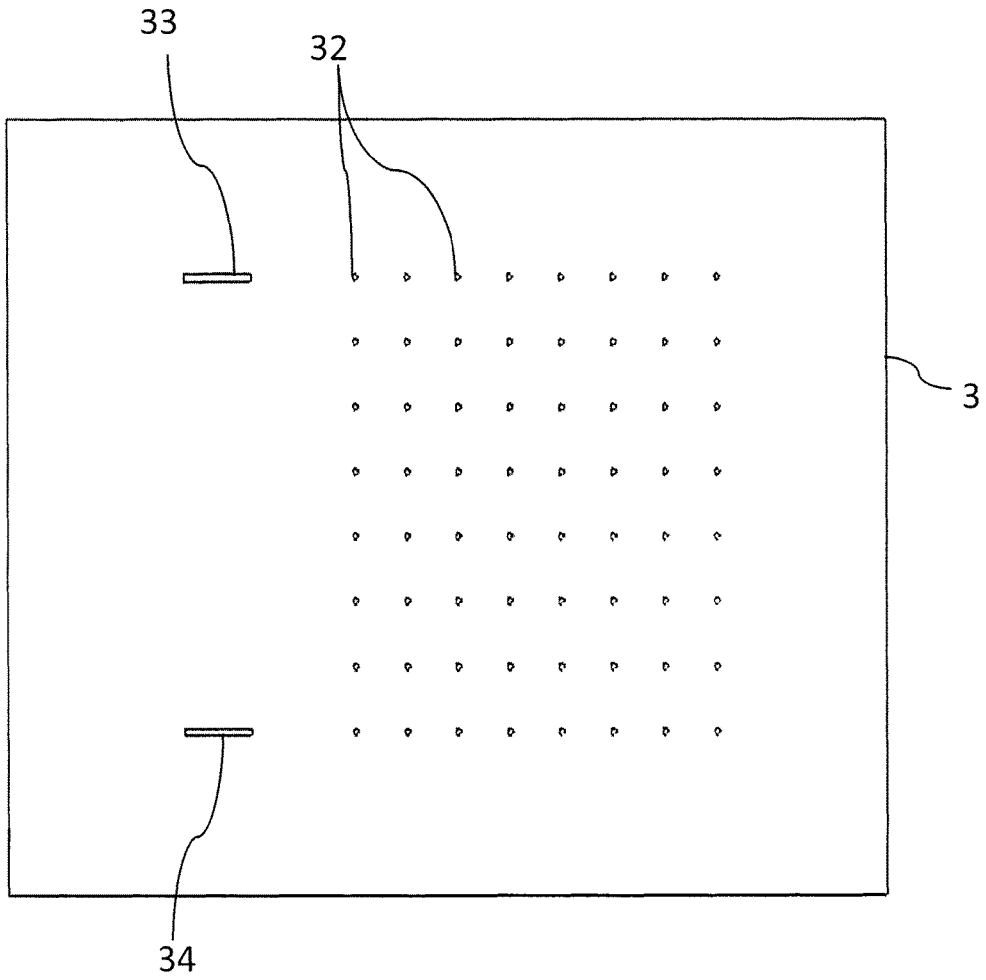
FIG. 7 shows an array formed on the top surface of the third plate, according to an embodiment of the invention.

FIG. 7 shows an array formed on the top surface of the third plate according to an embodiment of the invention. The third plate includes a plurality of wells 32 provided at a predetermined distance. In another embodiment of the invention, the third plate additionally includes two feeder channels 33 and 34. A number of wells 32 of predetermined dimensions are arranged in a two dimensional array, at a predetermined distance from the feeder channels 33 and 34. In a preferred embodiment of the invention, the distance between two wells is more than thrice the width of the wells. Further the wells 32 can be configured to form a 96-well array, a 384-well array or a 1536-well array. The distance between the wells 32 and the feeder channels 33 and 34 (FIG. 7) is in correspondence with the gap formed between the feeder channels 30, 31 and the microchannel 29 on the second plate 2 (FIG. 6).

The third plate 3 having the feeder channels 33, 34 and the array of wells 32 is offset with the bottom surface of the second plate 2 to form a continuous channel. The forming of the continuous channel facilitates the fluid to flow from the feeder port 15 through the feeder channel 31 into the array of wells 32. The fluid remaining then enters through second feeder channel 30 to be received at the receiver port 17.

Figure 8:
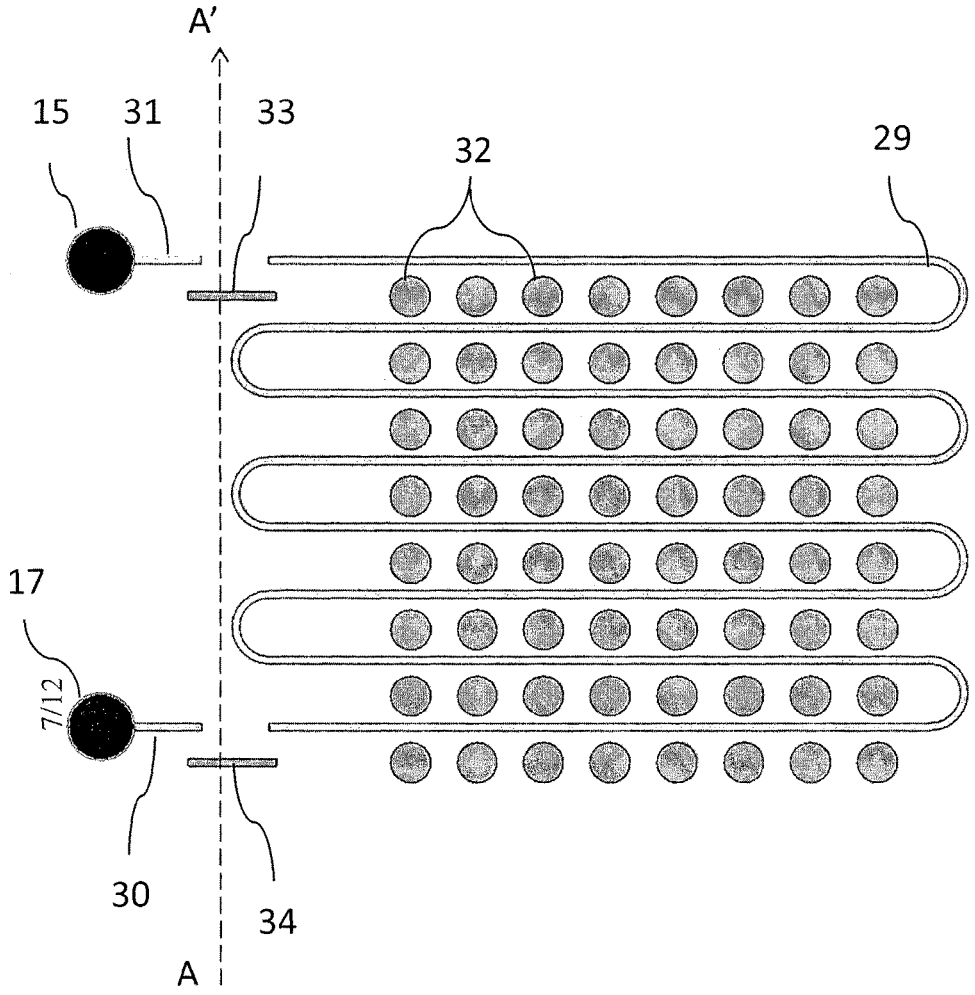
FIG. 8 shows the formation of the micro-droplet array, according to an embodiment of the invention.
Figure 9:
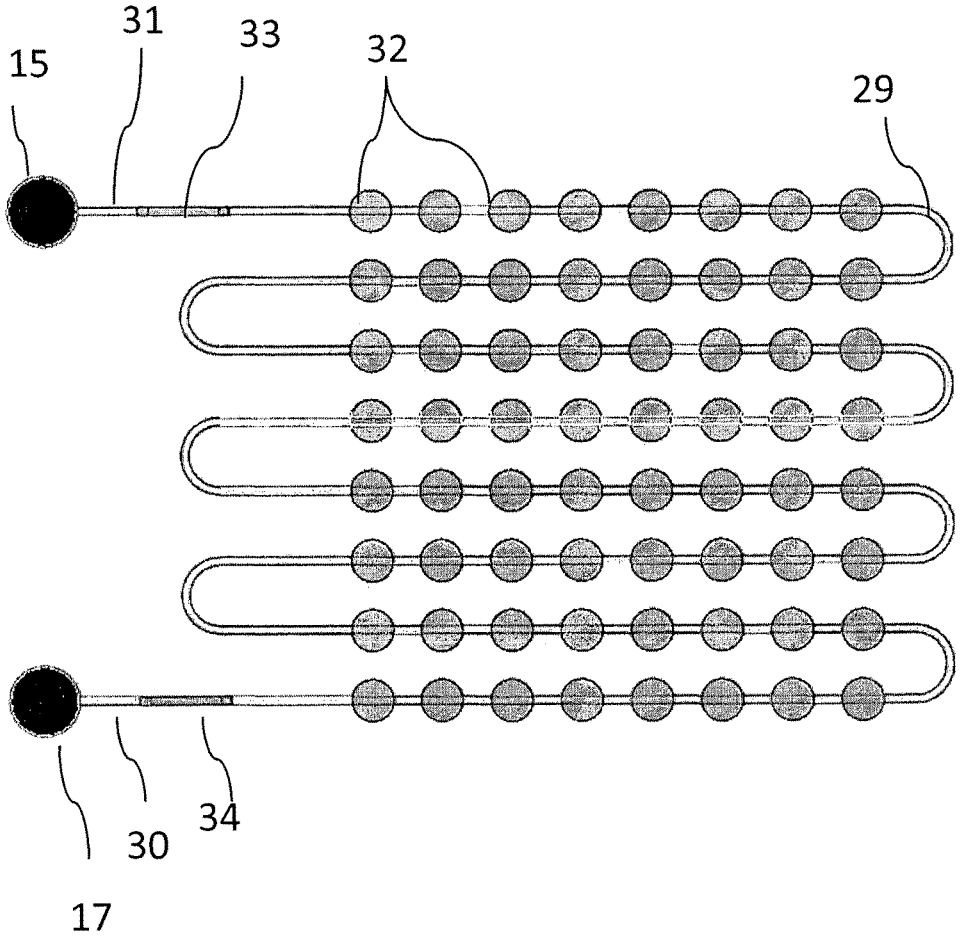
FIG. 9 shows the aligned microchannel of the second plate with the array of wells on the third plate, according to an embodiment of the invention.

FIG. 8 shows the formation of the micro-droplet array, according to an embodiment of the invention. The third plate 3 having the feeder channels 33 and 34 along with the wells 32 is offset with the feeder channels 30 and 31 of the second plate 2 to form a continuous channel along with the micro-channel 29. In one example of the invention, the offset is achieved by slipping the third plate 3 along the direction AA' as shown. The micro-droplets formed now flow continuously through the microchannel 29. FIG. 9 shows the aligned microchannel of the second plate 2 with the array of wells on the third plate, according to an embodiment of the invention. The micro-droplets formed are sequentially dispensed into the array of wells 32.

Figure 10:
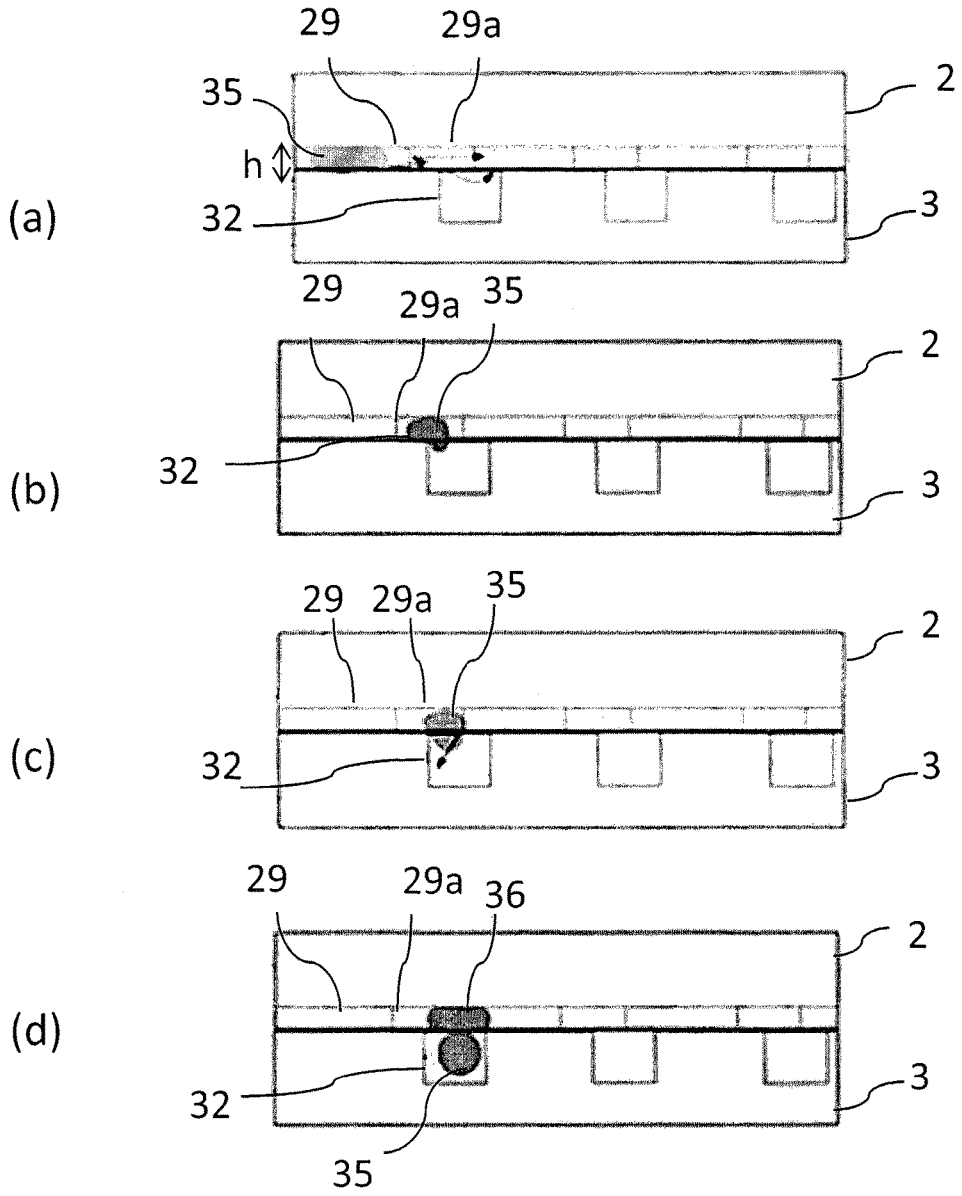
FIG. 10 shows the mode of arrangement of micro-droplet on the array, according to an embodiment of the invention.

FIG. 10 shows the mode of arrangement of the micro-droplets on the array, according to an embodiment of the invention. The height 'h' of the channel through which each of the micro-droplet 35 is travelling is less than the diameter of the micro-droplet 35, as a result the micro-droplet 35 is compressed and is in oblate ellipsoidal shape (a). The geometry of the wells 32, the channel 29 and the circular slot 29*a* results in a strong flow in the microfluidic channel 29 and in the circular slot 29*a*, while a weak flow in the wells 32. When the micro-droplet 35 in ellipsoidal shape arrives at the circular slot 29*a* it expands and acquires a circular shape. Simultaneously the micro-droplet 35 also enters the well 32 where it further expands thus minimizing its surface energy (b). When the micro-droplet 35 reaches at the end of the circular slot 29*a*, the strong flow tries to squeeze it into the microchannel 29. Simultaneously the bottom edge of the circular slot 29*a* also applies a force on the micro-droplet 35 blocking its motion and entrapping it into the well 32 (c). Presence of the micro-droplet 35 in the well 32, acts as a blockage for the weak flow, thus weakening it further. Consequently, the approaching micro-droplet 36 is now transported by the strong flow and flows past the already occupied well (d). The micro-droplet 36 now occupies the well downstream (not shown). Once all the wells in the array are filled, the second plate 2 is slipped back to break the continuity of the microchannel 29.

Figure 11:
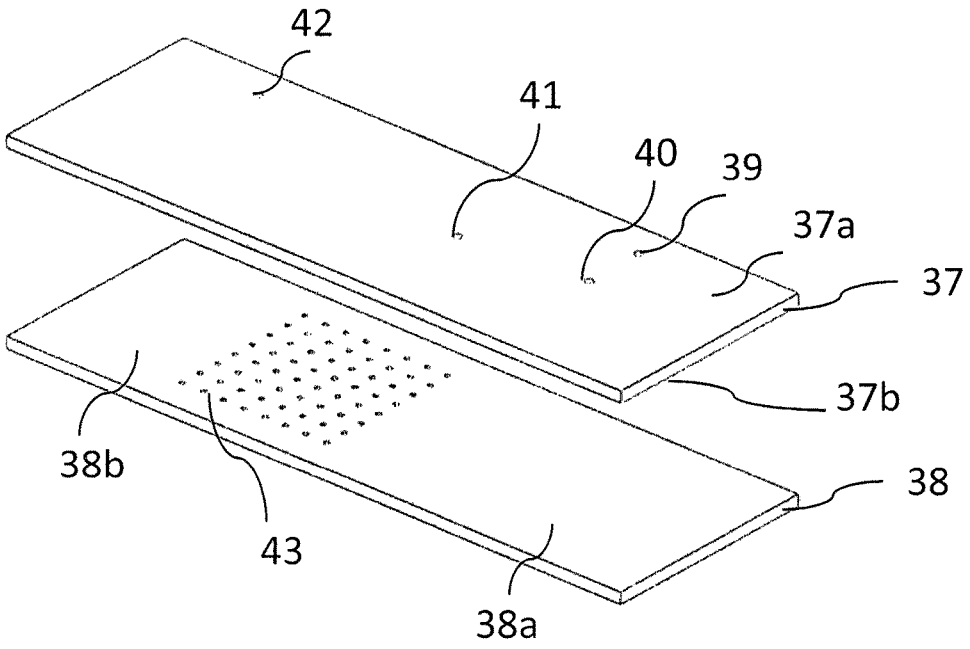
FIG. 11 shows an exploded view of the apparatus for formation of a micro-droplet array, according to an alternate embodiment of the invention.

FIG. 11 shows an exploded view of a micro-droplet array formation apparatus, according to an alternate embodiment of the invention. The micro-droplet array formation apparatus includes a first plate 37 and a second plate 38. The first plate 37 has a top surface 37*a* and a bottom surface 37*b*. The top surface 37*a* is provided with at least two ports 39, 40 for delivering at least two distinct fluids. The first fluid is a sample fluid and the second fluid is an immiscible fluid. An outlet 41 is provided for extracting the undesired micro-droplets after the sorting operation whereas outlet 42 enables extraction of fluids along with micro-droplets from the apparatus after trapping of the micro-droplets. The second plate 38 has a first end 38*a* and a second end 38*b*. A plurality of wells 43 are provided at the second end 38*b*.

Figure 12:
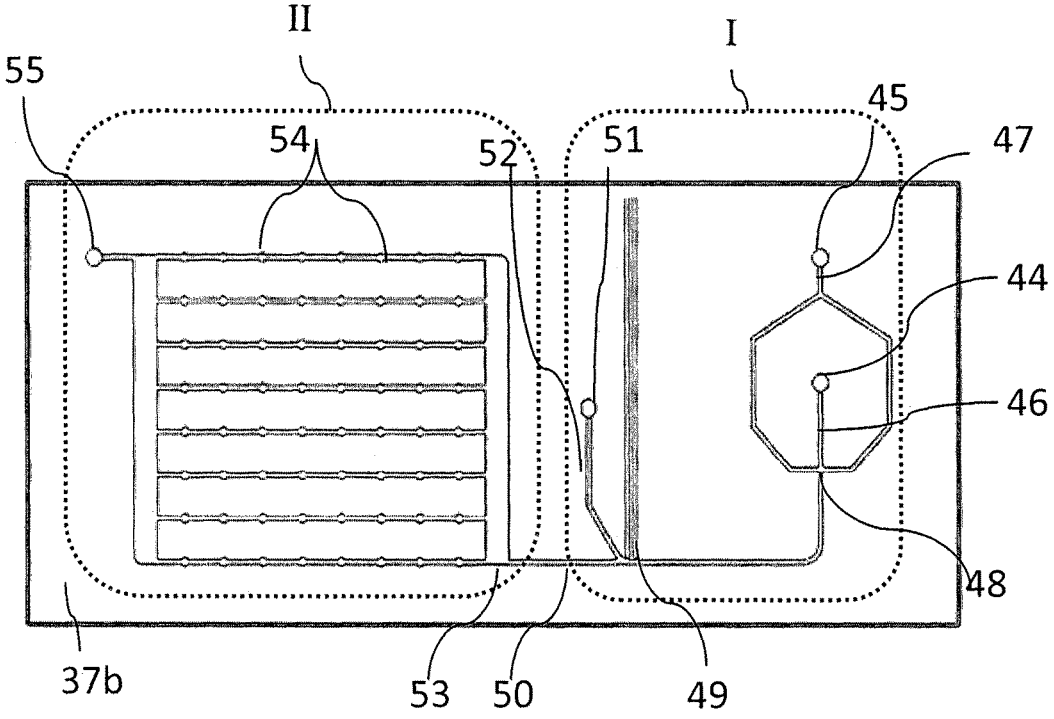
FIG. 12 shows a microfluidic circuit formed on the bottom surface of first plate, according to an alternate embodiment of the invention.

FIG. 12 shows a microfluidic circuit formed on the bottom surface of the first plate, according to an alternate embodiment of the invention. The bottom surface 37*b* of the first plate 37 is provided with a first microfluidic circuit I and a second microfluidic circuit II. The first microfluidic circuit I has input ports 44 and 45 for receiving fluids from inlets 39 and 40 of the first end 37*a* of the first plate 37(FIG. 11). The input ports 44 and 45 extend into microfluidic channels 46 and 47.

The input port 44 is configured for delivering the sample fluid. The input port 45 is configured for delivering the immiscible fluid. The microfluidic channels 46 and 47 are configured to form a junction 48. The sample flowing in from the channel 46 coalesces with the immiscible fluid flowing from the channel 47 to form a micro-droplet downstream of the junction 48. The micro-droplets formed encapsulate the sample. There are also micro-droplets formed without any sample.

To facilitate sorting of micro-droplets containing cellular entity, a droplet sorter 49 is provided proximal to the junction 48. The droplet sorter 49 is configured to receive the micro-droplets. The micro-droplets containing the sample are then directed to a connecting microchannel 50, subsequent to sorting. The micro-droplets without the sample are directed to a port 51 through a channel 52. The port 51 is accessible through the outlet 41 provided on the first end 37*a* (FIG. 11).

The connecting microchannel 50 directs the micro-droplets with the sample to the second microfluidic channel II. The second microfluidic channel II includes a microchannel 53 and an outlet 55 configured for recovery of the fluids. The microchannel 53 is provided with a plurality of circular slots 54 for trapping of the micro-droplets. Each of the circular slots 54 is at a predetermined distance from the preceding one throughout the length of the microchannel 53. The distance between any two consecutive circular slots 54 is same as the distance between any two consecutive wells 43 in the second end 38*b* of the second plate 38. The outlet 55 is accessible through the outlet 42 provided on the first end 37*a* of the first plate 37 (FIG. 11). The micro-droplet array thus formed has presence of a thin film of immiscible fluid. The coating of the micro-droplet array with the thin film of immiscible fluid prevents evaporation of trapped micro-droplets. Alternatively, the micro-droplet array can be covered by another plate, wherein the plate has access ports for accessing the micro-droplets. Once the micro-droplets are exposed to the surrounding, operations such as drug delivery and probing can be performed on the cellular entities present in the micro-droplets. Thus the invention provides an apparatus for formation of a micro-droplet array for multiple screening of a sample where micro-droplets containing single cellular entities are trapped in the wells of the apparatus. The cellular entities present in the micro-droplets are exposed and are accessible for probing and multiple screening.

The invention as described herein above provides an apparatus for formation of a micro-droplet array for multiple screening of a sample. The foregoing description of the invention has been set for merely to illustrate the invention and is not intended to be limiting. Since modifications of the disclosed embodiments incorporating the spirit and substance of the invention may occur to person skilled in the art, the invention should be construed to include everything within the scope of the appended claims and equivalents thereof.

We claim:

1. A micro-droplet array formation apparatus comprising:

a first plate including a first pair of ports and a second pair of ports;

a second plate including a top surface including a first microfluidic circuit containing a third pair of ports, said third pair of ports are respectively fluidically connected to said first pair of ports, a bottom surface including a second microfluidic circuit fluidically connected to the first microfluidic circuit, the second microfluidic circuit containing a microchannel including at least two spaced-apart circular slots; and a third plate including a two dimensional micro array including at least two spaced-apart circular wells corresponding to the at least two spaced-apart circular slots, said at least two circular wells are respectively fluidically connected to the at least two spaced-apart circular slots of the microchannel of said bottom surface of said second plate;

wherein the second plate is reversibly or irreversible connected to and below a bottom surface of the first plate and the third plate is reversibly or irreversibly connected to and below the bottom surface of the second plate.

2. The apparatus of claim 1, wherein the first microfluidic circuit on top of said second plate further comprises:

a plurality of microchannels including at least one microchannel junction configured for forming at least one microdroplet; and a sorter fluidically connected to said at least one microchannel junction configured for sorting said at least one microdroplet based on the presence of a single cellular entity in the at least one microdroplet.

3. The apparatus of claim 2, the first microfluidic circuit comprises a feeder port and a receiver port connected to said microchannel of the second microfluidic circuit.

4. The apparatus of claim 2, wherein at least one micro-droplet containing said single cellular entity is located within each of said at least two spaced-apart circular slots.

5. The apparatus of claim 4, wherein said at least two spaced-apart circular slots containing at least one micro-droplet containing said single cellular entity form part of a micro droplet array, and said at least two circular wells are configured to retrievably hold the single cellular entity.

6. The apparatus of claim 5, wherein the distance between the at least two spaced-apart circular slots is equal to the distance between the at least two spaced-apart circular wells.

* * * * *